US005427080A

United States Patent [19]

Maeda et al.

[11] Patent Number: 5,427,080

[45] Date of Patent: Jun. 27, 1995

[54] EXHAUST GAS RECYCLING DEVICE AND PROCESS FOR PRODUCING SAME

[75] Inventors: Fumihiko Maeda, Yakushiji; Seikichi Manaka, Ibaraki, both of Japan

[73] Assignees: Honda Giken Kogyo Kabushiki Kaisha, Tokyo; Showa Aluminum Corporation, Osaka, both of Japan

[21] Appl. No.: 81,054

[22] Filed: Jun. 25, 1993

[30] Foreign Application Priority Data

Jun. 26, 1992 [JP] Japan ..... 4-169547

[51] Int. Cl.[6] ..... F02M 23/04

[52] U.S. Cl. ..... 123/568; 123/184.42; 123/184.47

[58] Field of Search ..... 123/568, 184.42, 184.47

[56] References Cited

U.S. PATENT DOCUMENTS

| | | | |
|---|---|---|---|
| 3,294,073 | 12/1966 | Bressan | 123/568 |
| 4,169,471 | 10/1979 | August | 123/568 |
| 4,258,687 | 3/1981 | Mauch et al. . | |
| 4,516,538 | 5/1985 | Arakawa et al. . | |
| 4,570,603 | 2/1986 | Piedrafita . | |

FOREIGN PATENT DOCUMENTS

| | | | |
|---|---|---|---|
| 251180 | 1/1988 | European Pat. Off. | 123/184.42 |
| 3107898 | 3/1980 | Germany . | |
| 2-211369 | 8/1990 | Japan . | |

*Primary Examiner*—Douglas Hart

*Attorney, Agent, or Firm*—Armstrong, Westerman, Hattori, McLeland & Naughton

[57] ABSTRACT

An exhaust gas recycling device for use in reducing the nitrogen oxide ($NO_x$) concentration of exhaust gases from gasoline engines has between two metal plates superposed on each other a main channel defined by a first inflated portion of large cross section, and at least one branch channel defined by a second inflated portion communicating with the main channel and having a small cross section. The device comprises a single component provided by two metal plates, and is simple in construction and reduced in the number of parts, manufacturing cost and weight. The device is produced by roll-bonding two metal plates, forming at least one second inflated portion having a small cross section and defining the branch channel by primary inflation with a low fluid pressure, thereafter holding the two metal plates with dies, and forming a first inflated portion having a large cross section and defining the main channel by secondary inflation with a high fluid pressure.

4 Claims, 5 Drawing Sheets

EXHAUST GAS RECYCLING DEVICE AND PROCESS FOR PRODUCING SAME

BACKGROUND OF THE INVENTION

The present invention relates to exhaust gas recycling devices and a process for producing the device.

The term "aluminum" as used herein and in the appended claims includes pure aluminum and aluminum alloys.

It is generally thought that the nitrogen oxide ($NO_x$) concentration of exhaust gases from gasoline engines can be reduced most effectively by returning a portion (5 to 20%) of the exhaust gas to the intake gas, i.e., by the EGR (exhaust gas recycling) method. When subjected to the high temperature of combustion gases, the nitrogen and oxygen in air react to form nitrogen oxides. Accordingly, the recycling of the exhaust gas lowers the temperature of combustion gas to inhibit the reaction between nitrogen and oxygen.

The device for recycling exhaust gases is interposed between an EGR valve and the intake manifold of the gasoline engine. Heretofore known as such devices are those prepared by casting.

However, the conventional exhaust gas recycling devices made of casting have the problem of consisting of many parts and being cumbersome and costly to manufacture and heavy.

SUMMARY OF THE INVENTION

The present invention provides an exhaust gas recycling device free of the above problem and a process for producing the device.

The present invention provides an exhaust gas recycling device which is characterized in that the device comprises two metal plates superposed on each other, at least one of the metal plates being formed with a first inflated portion having a relatively large cross section and defining a main gas channel, and at least one second inflated portion integral with one side of the first inflated portion and having a relatively small cross section to define a branch gas channel in communication with the main channel, the two metal plates being joined to each other except at the first and second inflated portions, one of the metal plates having a gas inlet communicating with the main channel and at least one gas outlet communicating with the branch channel and connectable to an intake manifold.

With the exhaust gas recycling device of the invention, a portion of exhaust gas is introduced into the inlet of the main gas channel, for example, via an EGR value, whereupon the exhaust gas flows into the main channel and further smoothly flows into the branch channel. Accordingly, the exhaust gas to be recycled uniformly flows through the device. The main channel has a relatively large cross section and a sufficient gas capacity for recycling, therefore lowers the temperature of the exhaust gas to a required level for recycling, mitigates the influence of variations in the gas flow rate and ensures a uniform recycle flow. Moreover, the smooth flow of recycle gas diminishes the pressure loss to be involved. The exhaust gas thus recycled lowers the temperature of combustion gas of the gasoline engine to inhibit the reaction between nitrogen and oxygen and reduce the nitrogen oxide ($NO_x$) concentration of the exhaust gas.

Furthermore, the exhaust gas recycling device comprises a single component provided by two metal plates and is therefore simple in construction and reduced in the number of parts, manufacturing cost and weight, while a complex exhaust gas channel structure can be realized properly with ease for recycling a fraction of the exhaust gas in conformity with the characteristics of the particular type of engine contemplated.

The exhaust gas recycling device of the invention is further characterized in that the branch gas channel in communication with the main channel is divided by way of a bifurcated passageway at the outer end thereof into two gas discharge channels having a large area when seen from above, and the gas outlet connectable to the intake manifold is formed in a metal plate portion defining each of the discharge channels at the lower side thereof.

Each of the discharge channels of large area may be formed at a side portion thereof with an opening during the fabrication of the device. The metal plate portions defining the opening are in this case bonded together by a press, and the opening is sealed off and made hermetic.

The exhaust gas recycling device of the present invention is further characterized in that the first inflated portion has a relatively large approximately circular cross section, and a plurality of branch channels are provided on one side of the first inflated portion in communication with the main gas channel inside the inflated portion, a gas inlet channel being provided on the other side of the first inflated portion in communication with the main channel, the joined metal plates being bent downward at front and rear opposite side edge portions thereof to provide the gas inlet at the outer end of the gas inlet channel and the gas outlet at the outer end of each branch channel, the inlet and the outlet being open downward.

The exhaust gas recycling device having the above feature requires no boring, is reduced in the length of sealed portion formed by welding and made easier to manufacture, achieves a reduction in the manufacturing cost and has an airtight structure of improved reliability.

The present invention also provides a process for producing an exhaust gas recycling device characterized by printing a bonding preventing agent in a required pattern on one of the opposed surfaces of two metal plates to be superposed on each other, bonding the two metal plates together under pressure as superposed, thereafter applying a relatively low fluid pressure to nonbonded portions of the two metal plates to form in at least one of the metal plates a channel-defining primarily inflated portion and at least one second inflated portion integral with one side of the inflated portion, the second inflated portion defining a branch gas channel having a relatively small cross section inside thereof, subsequently holding the metal plates between a pair of upper and lower forming dies, the dies having opposed surfaces respectively in contact with opposite outer surfaces of the second inflated portion and having secondary forming cavities positioned at opposite sides of the primarily inflated portion, thereafter applying a high fluid pressure to the interior of the primarily inflated portion to thereby form a first inflated portion having a relatively large cross section and defining a main gas channel, and forming in one of the metal plates a gas inlet communicating with the main channel and at least one gas outlet communicating with the branch channel and connectable to an intake manifold.

The exhaust gas recycling device can be produced very efficiently with greatly improved productivity by the process of the invention from two metal plates utilizing the roll bonding method.

With the process of the present invention, the primary inflation step is followed by the secondary inflation step with use of a high air pressure. The process therefore does not require, for example, a cleaning step and drying step which are needed for removing a lubricant when a mandrel is used in the secondary step for enlarging the primarily inflated portion, hence a greatly reduced cost. One open end portion of the main channel for introducing the high-pressure gas therethrough can be easily closed as by welding, and the portion to be sealed is short, so that the device can be given airtightness with greatly improved reliability. Moreover, the process readily ensures dimensional accuracy as required to provide a product of good quality.

The metal plates to be used in the above process are usually aluminum plates, which however can be replaced by other metal plates.

In the foregoing process for producing the present device, the primarily inflated portion is formed first by applying a relatively low fluid pressure, for example, of water or oil to the nonbonded portions of the two metal plates. On the other hand, the main gas channel is formed by the secondary step by introducing a fluid of high pressure, such as pressurized air, into the primarily inflated portion.

The exhaust gas recycling device usually has one main channel of relatively large cross section, and the gas inlet is in communication with one end of this main channel. Although at least one branch gas channel of relatively small cross section is provided in communication with the main channel, the number of gas outlets is, for example, two, four or six, depending on the intake manifold, i.e., the number of engine cylinders. The branch pipe is formed with at least one gas outlet accordingly.

Although the exhaust gas recycling device of the invention is produced utilizing the roll bonding method, the device can alternatively be fabricated by the press method. In this case, a press is used for forming in one of two metal plates a furrow for providing a first inflated portion of relatively large cross section and a furrow for providing at least one second inflated portion integral with one side of the first inflated portion and having a relatively small cross section. The other metal plate is fitted to the furrowed surface of the plate, and the two plates are joined together by brazing except at the furrowed portions for providing the first and second inflated portions to provide a main gas channel and a branch gas channel in communication with the main channel. The other metal plate is worked on to form a gas inlet communicating with the main channel and at least one gas outlet communicating with the branch channel and connectable to an intake manifold.

The present invention will be described in greater detail with reference to the accompanying drawings.

DESCRIPTION OF THE PREFERRED EMBODIMENTS

Figure 1:
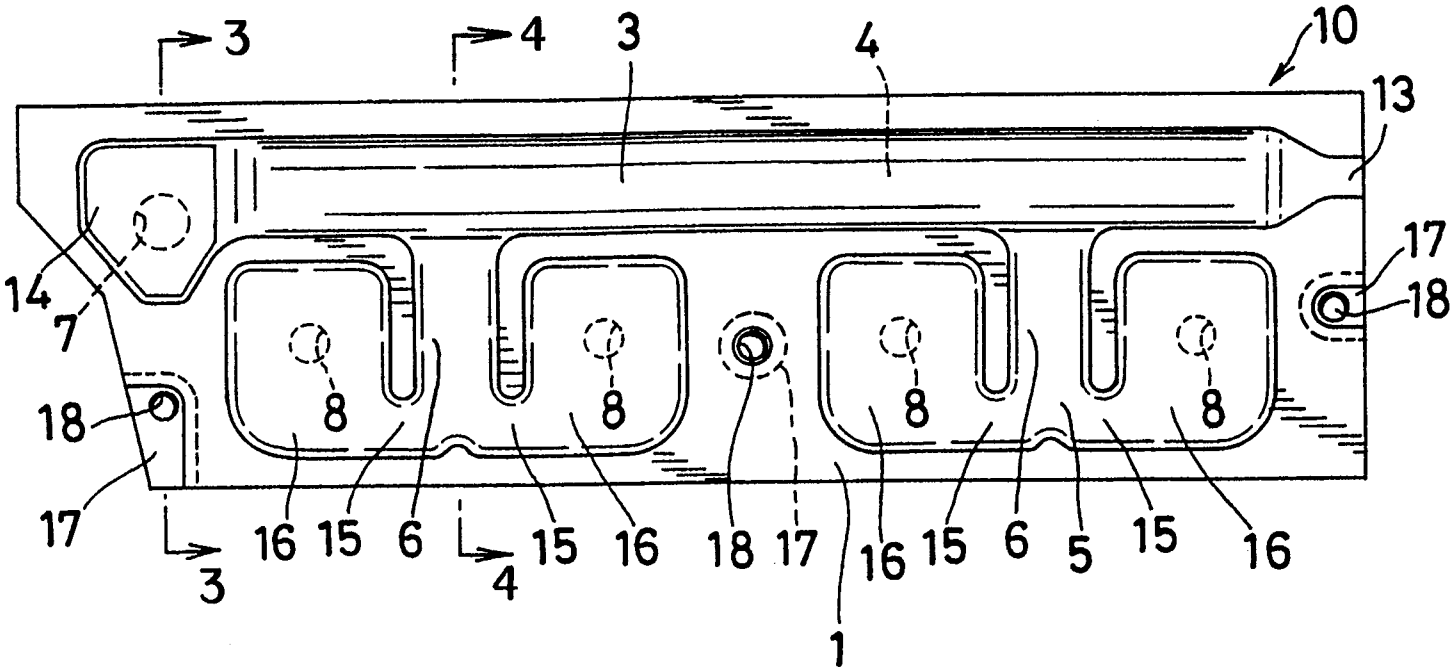
FIG. 1 is a plan view of an exhaust gas recycling device as a first embodiment of the invention.
Figure 2:
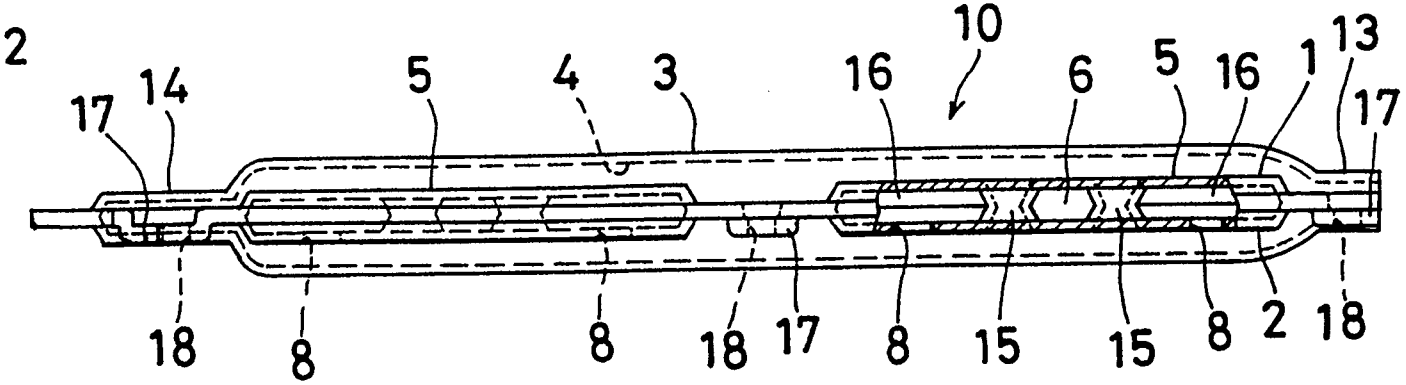
FIG. 2 is a side elevation partly broken away and showing the same.
Figure 3:
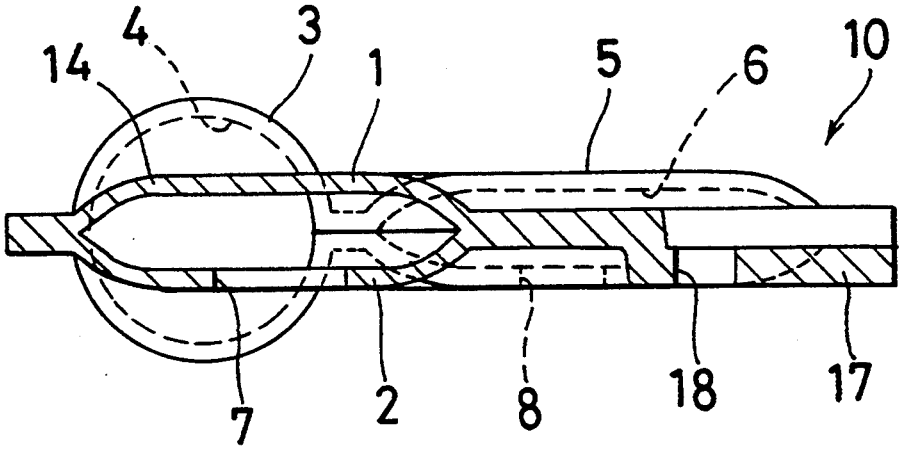
FIG. 3 is an enlarged view in section taken along the line A—A in FIG. 1.
Figure 4:
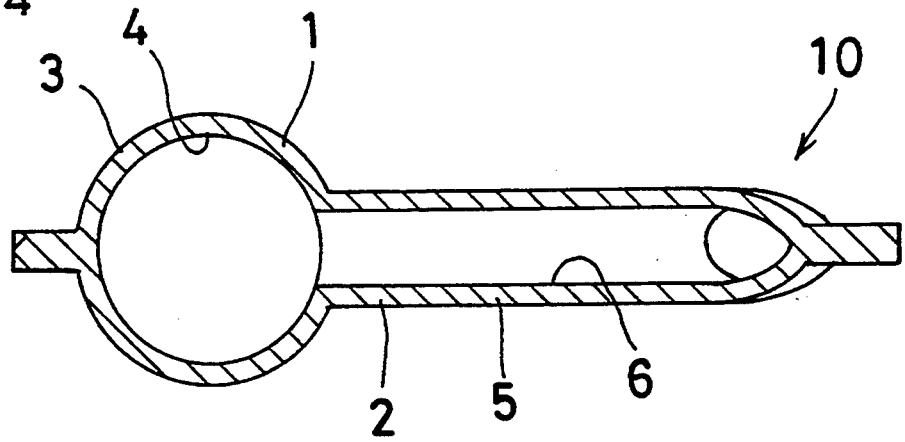
FIG. 4 is an enlarged view in section taken along the line B—B in FIG. 1.

Throughout the drawings, like parts are designated by like reference numerals.

With reference to FIGS. 1 to 4 showing a first embodiment of the present invention, i.e., an exhaust gas recycling device 10, the device 10 comprises two aluminum plates 1, 2 superposed on each other. The superposed aluminum plates 1, 2 have a first inflated portion 3 of a relatively large cross section to define a main gas channel 4, and two second inflated portions 5 integral with one side of the first inflated portion 3 and having a relatively small cross section. Each of the second inflated portions 5 defines a branch gas channel 6. The two aluminum plates 1, 2 are bonded together under pressure except at the first and second inflated portions 3, 5.

The main channel 4 has a relatively large circular cross section generally in its entirety except opposite end portions 13, 14 thereof and is sufficiently great in its capacity to accommodate the exhaust gas to be recycled. The right and left end portions 13, 14 of the main channel 4 have a relatively small cross section like the branch channels 6. The right end portion 13 is tapered and has an extremity which is closed, for example, by argon welding. The left end portion 14 of the main channel 4 serves as a gas inlet channel. At the left end portion 14, the lower metal plate 2 has a gas inlet 7. Because of the sufficient capacity to accommodate the exhaust gas to be recycled, the main channel 4 lowers the temperature of the gas to be recycled to a required level, diminishes the influence of variations in the exhaust gas flow rate and ensures a uniform flow of the exhaust gas fraction to be recycled.

On the other hand, each of the branch channels 6 has a relatively small cross section and is divided into two gas discharge channels (circuit channels) 16, 16 having a large area when seen from above by way of a bifurcated passageway, i.e., communication channels 15, 15, at the outer end of the channel 6. The portion of the lower metal plate 2 defining each discharge channel (circuit channel) 16 has a gas outlet 8 to be connected to an intake manifold 20.

A downward projection 17 is provided at each of the central portion and opposite end portions of the recycling device 10, and has a mount screw bore 18.

Figure 7:
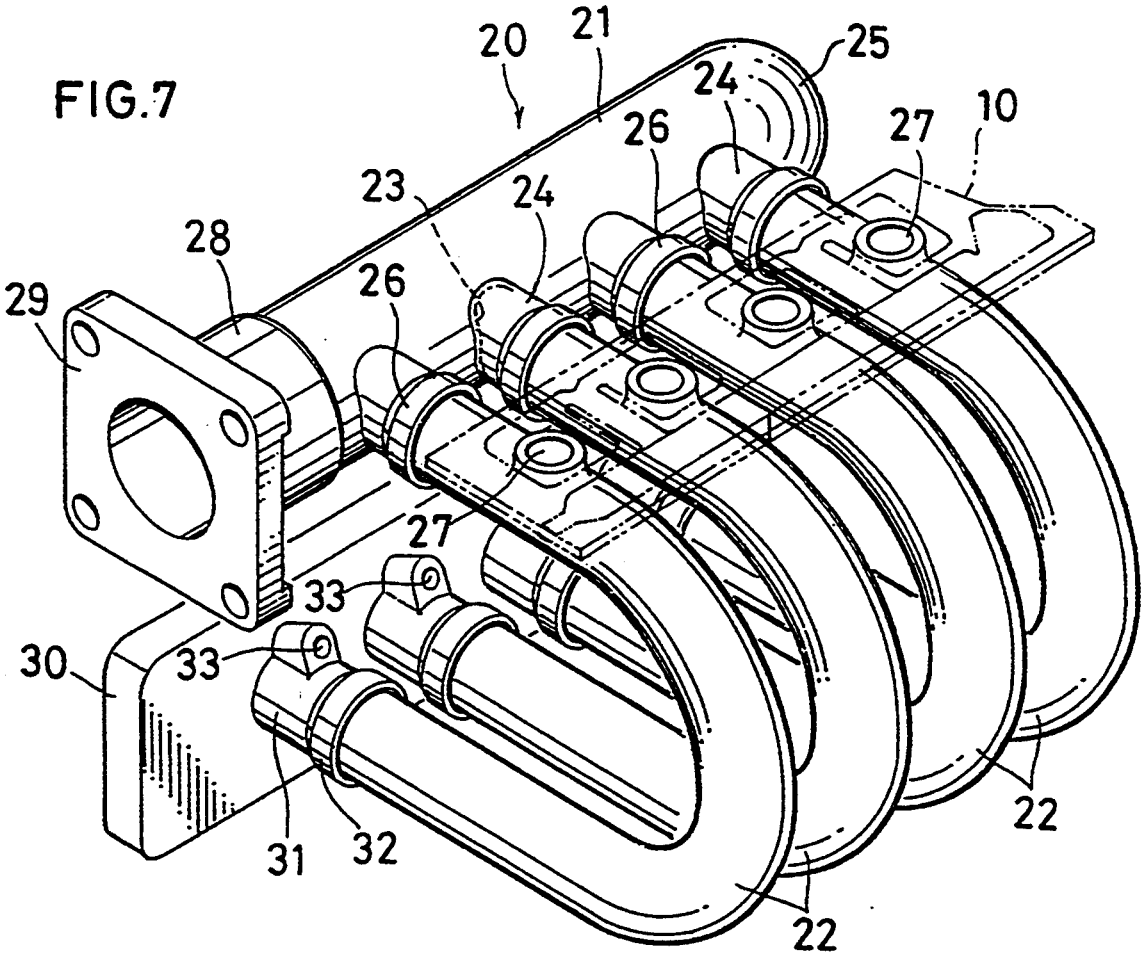
FIG. 7 is a perspective view showing an example of intake manifold.

The exhaust gas recycling device 10 is used as interposed between an ERG valve (not shown) and the intake manifold 20 of a gasoline engine. FIG. 7 shows the intake manifold in detail.

With reference to this drawing, the intake manifold 20 comprises a plenum chamber 21 made of a wrought aluminum material and having an open end and a closed end, and four branch pipes 22 similarly made of a wrought aluminum material and approximately U-shaped when seen from one side. The plenum chamber 21 has four holes 23 formed in one side of its peripheral wall, a tubular outer projection 24 formed around each of the holes 23 integrally with the wall for connection to the branch pipe 22, and an enlarged tubular portion 26 provided at the outer end of the projection 24. The branch pipe 22 has its one end fittingly joined to the enlarged tubular portion 26 of the projection 24.

Each branch pipe 22 has an upper straight portion which is centrally formed with an inlet opening 27 facing upward for introducing therethrough the exhaust gas to be recycled. As indicated in dot-and-dash lines in the same drawing, the exhaust gas recycling device 10 is placed on and extends across the straight upper portions of the four branch pipes 22. The four gas outlets 8 of the device 10 are held in communication with the inlet openings 27 of the respective branch pipes 22 with a packing (not shown) provided therebetween.

The closed end of the plenum chamber 21 is provided by an outwardly bulging semicircular closure wall 25 having a concave inner surface. Secured to the open end of the plenum chamber 21 is a tubular member 28, one end of which is integrally provided with a flange 29. An unillustrated throttle body having a throttle valve incorporated therein is attached to the tubular member 28. The throttle body has connected thereto an air conduit extending from an air cleaner. The other end of each branch pipe 22 is connected to an aluminum connector 30 for attaching the pipe to an engine cylinder head (not shown). Through the connector 30, the branch pipe 22 is held in communication with the engine cylinder. The connector 30 is in the form of a horizontally elongated rectangle, has four holes (not shown) and is integrally provided with tubular outward projection 31 each around the hole. An enlarged tubular portion 32 is provided at the outer end of the projection 31. The projection 31 of the connector 30 is provided with a fuel injector socket 33 thereon. The branch pipe 22 is inserted in and brazed to the tubular portion 32 at the outer end of the projection 31.

The nitrogen oxide ($NO_x$) concentration of exhaust gases from gasoline engines can be reduced most effectively by recycling a portion (5 to 20%) of the exhaust gas to the intake gas, i.e., by the EGR method. When the exhaust gas from the gasoline engine is partially introduced into the inlet 7 of the main channel 4 of the exhaust gas recycling device 10, for example, by way of an ERG valve, the exhaust gas flows through the main channel 4 into the two branch channels 6 smoothly. Thus, the fraction of exhaust gas to be recycled uniformly flows through the device. The main channel 4 has a relatively large cross section and a sufficient capacity to accommodate and recycle the exhaust gas, therefore lowers the temperature of the exhaust gas to the desired level, diminishes the influence of variations in the gas flow rate and permits the exhaust gas fraction to be recycled to uniformly flow therethrough. Since the exhaust gas flows smoothly for recycling, the pressure loss involved is smaller.

The exhaust gas to be recycled flows through the bifurcated passageway at the outer end of each branch channel 6, i.e., through the communication channels 15, 15, into the two discharge channels (circuit channels) 16, 16 and further flows out from the gas outlets 8, 8 into the inlet openings 27 in the corresponding branch pipes 22 of the intake manifold 20.

The exhaust gas thus recycled lowers the temperature of combustion gas of the gasoline engine to inhibit the reaction between nitrogen and oxygen, reducing the nitrogen oxide ($NO_x$) concentration of the exhaust gas.

Figure 5:
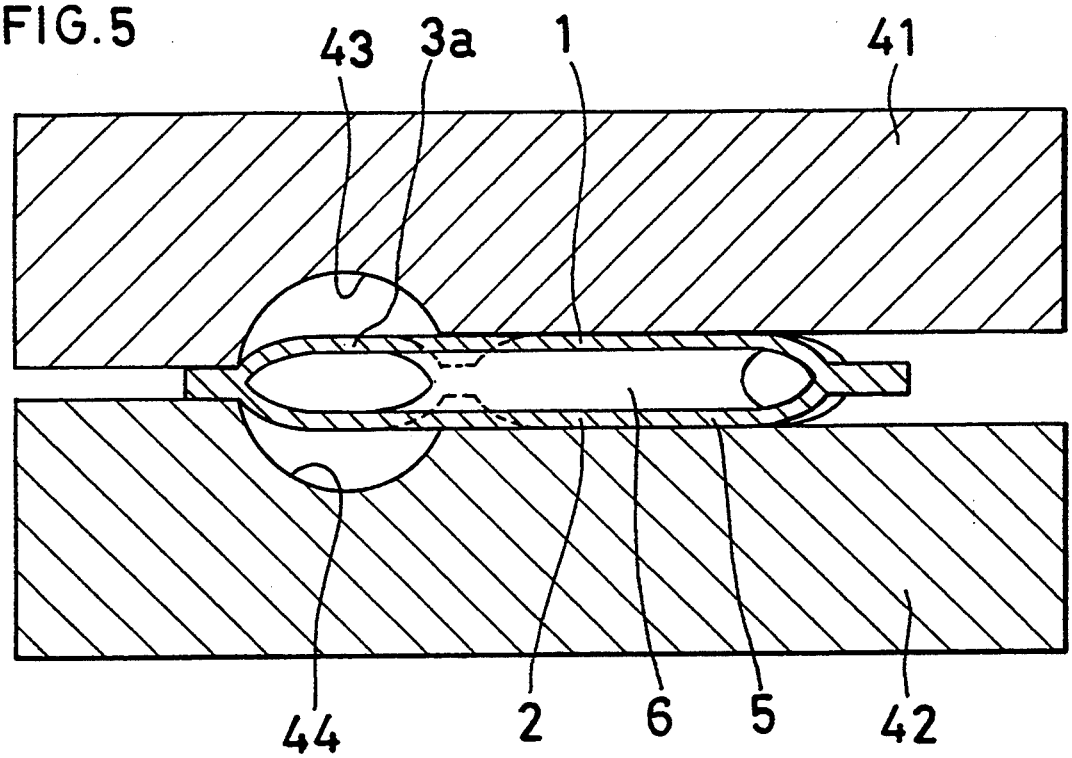
FIG. 5 is an enlarged fragmentary view in section for illustrating a process step of producing the device of first embodiment, the view showing a channel-defining primarily inflated portion formed in a first step before a pressurized fluid is introduced into the inflated portion.
Figure 6:
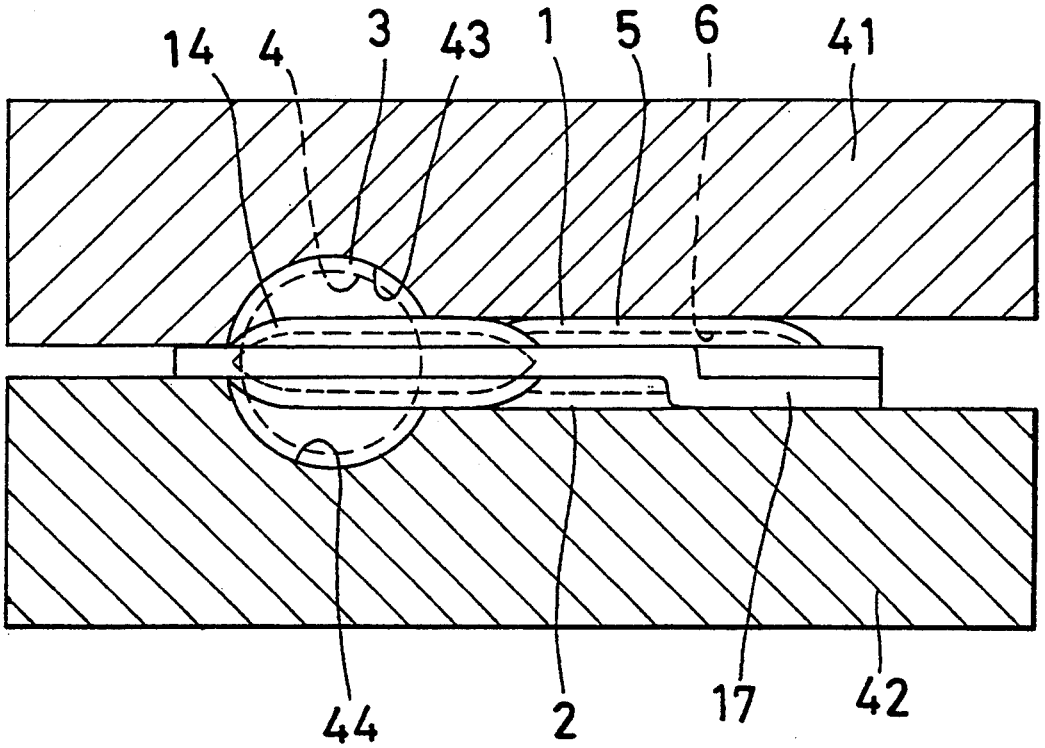
FIG. 6 is an enlarged fragmentary view in section for illustrating another production step, i.e., a second step in which the fluid has been introduced into the inflated portion.

The exhaust gas recycling device 10 is produced by the process of the invention to be described below with reference to FIGS. 5 and 6 and utilizing the roll bonding method.

First, an unillustrated parting agent (bonding preventing agent) is printed in a predetermined pattern on one of two aluminum plates 1, 2, the other plate is bonded to the print-bearing surface of the plate under pressure, and a relatively low pressure of fluid such as water or oil is thereafter applied to the nonbonded portions of the two aluminum plates 1, 2, thereby causing the plates 1, 2 to form a channel-defining primarily inflated portion 3*a* and two second inflated portions 5 integral with one side of the inflated portion 3*a* (double-side inflation). The primarily inflated portion 3*a* has the same height as the second inflated portion 5, and the left end portion 14 of the portion 3*a* for providing a gas inlet channel is closed, while the right end portion 13 is tapered and open. On the other hand, each of the second inflated portion 5 provides inside thereof a branch gas channels 6 which is relatively small in cross section and has a bifurcated passageway, i.e., communication channels 15, 15, and two gas discharge channels (circuit channels) 16, 16 extending from the respective channels 15, 15 (see FIG. 5).

Next, the two aluminum plates 1, 2 are held between a pair of upper and lower forming dies 41, 42. The upper and lower dies 41, 42 have opposed surfaces respectively in contact with opposite outer surfaces of the second inflated portion 5 and have secondary forming cavities 43, 44 positioned at opposite sides of the primarily inflated portion 3*a*. In this state, air having a high pressure is introduced into the primarily inflated portion 3*a* through the tapered open right end portion 13, whereby a first inflated portion 3 is formed which has a relatively large circular cross section almost in its entirety except the end portions 13, 14 and which defines a main gas channel 4 (see FIG. 6).

Subsequently, the extremity of the tapered right end portion 13 is closed, for example, by argon welding, a gas inlet 7 is formed in the portion of metal plate 2 serving as the lower wall of the left end portion 14, and gas outlets 8, 8 are formed also in the portion of the lower metal plate 2 defining each of the discharge channels (circuit channels) 16, 16. A downward projection 17 is formed at each of opposite end portions and central portion of the recycling device 10, and has a mount screw hole 18.

The process described above utilizes the roll bonding method for producing the exhaust gas recycling device 10 from two aluminum plates 1, 2, so that the device 10 is available with a very high efficiency and greatly increased productivity at a low manufacturing cost.

In the above process, water, oil or like fluid of relatively low pressure is used for primary inflation to form the primarily inflated portion 3a, into which air of high pressure is introduced through the tapered open right end portion 13 for secondary inflation. It appears possible to enlarge the primarily inflated 3a using a mandrel (not shown) in the secondary forming step.

In this case, a primarily inflated portion 3a is formed by primary inflation first which portion has the same width generally in its entirety without tapering the right end portion 13. An enlarging mandrel is thereafter inserted into the primarily inflated portion 3a through its right end portion 13 which is left open to enlarge the entire inflated portion 3a to a first inflated portion 3 having a greater circular cross section generally in its entirety and defining a main gas channel 4 inside thereof. A lubricant needs to be applied to the inner surface of the primarily inflated portion 3a before the insertion of the mandrel. Accordingly, the enlarged portion 3 formed by the mandrel is thereafter washed and dried for the removal of the lubricant. The enlarged open end of the first inflated portion 3 is then closed by a press and sealed off by welding to ensure airtightness.

However, when the mandrel is used for the secondary enlarging step, the recycling device 10 becomes very cumbersome and costly to manufacture, while the sealed portion is long and therefore less reliable as to airtightness. Moreover, the press work for closing the open end of the first inflated portion 3 entails the problem that the closed portion is liable to deformation and difficult to make dimensionally accurate as required.

In contrast, the process of the invention wherein the completion of primary inflation is followed by secondary inflation with use of air of high pressure assures facilitated manufacture of the exhaust gas recycling device 10, obviates the need for the lubricant removing step and drying step and can be practiced at a very low cost. The right end portion 13 of the main channel 4 is tapered, can therefore be closed easily as by argon welding and is shorter in the length of seal, assuring the device of airtightness with greatly enhanced reliability. The open end portion is less prone to deformation owing to press work for closing and can be readily dimensioned accurately as required. Thus, a product of good quality is available.

Figure 11:
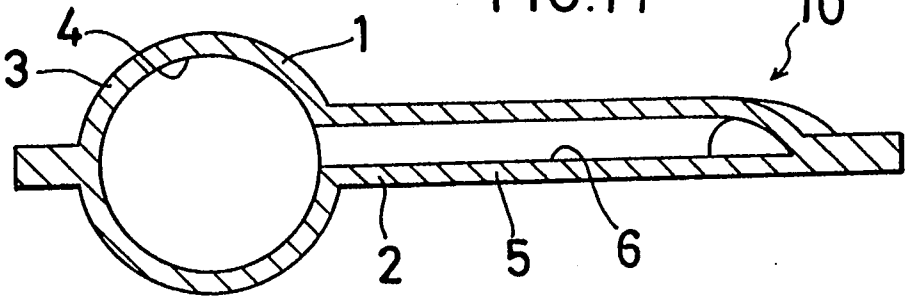
FIG. 11 is an enlarged sectional view corresponding to FIG. 3 and showing a modified exhaust gas recycling device embodying the invention.

With reference to FIG. 11 showing a modification of the first embodiment described, i.e., an exhaust gas recycling device 10, the device 10 is produced by one-side inflation resorting to the roll bonding method. In this case, one of two aluminum plates 1, 2 superposed on each other is formed with a first inflated portion 3 having a relatively large cross section and defining a main gas channel 4, and second inflated portions 5 integral with one side of the first inflated portion 3 and having a relatively small cross section. Each of the second inflated portions 5 defines a branch gas channel 6 communicating with the main channel 4.

Although not shown, the process for producing the recycling device 10 by one-side inflation is similar to the process for producing the first embodiment.

Figure 8:
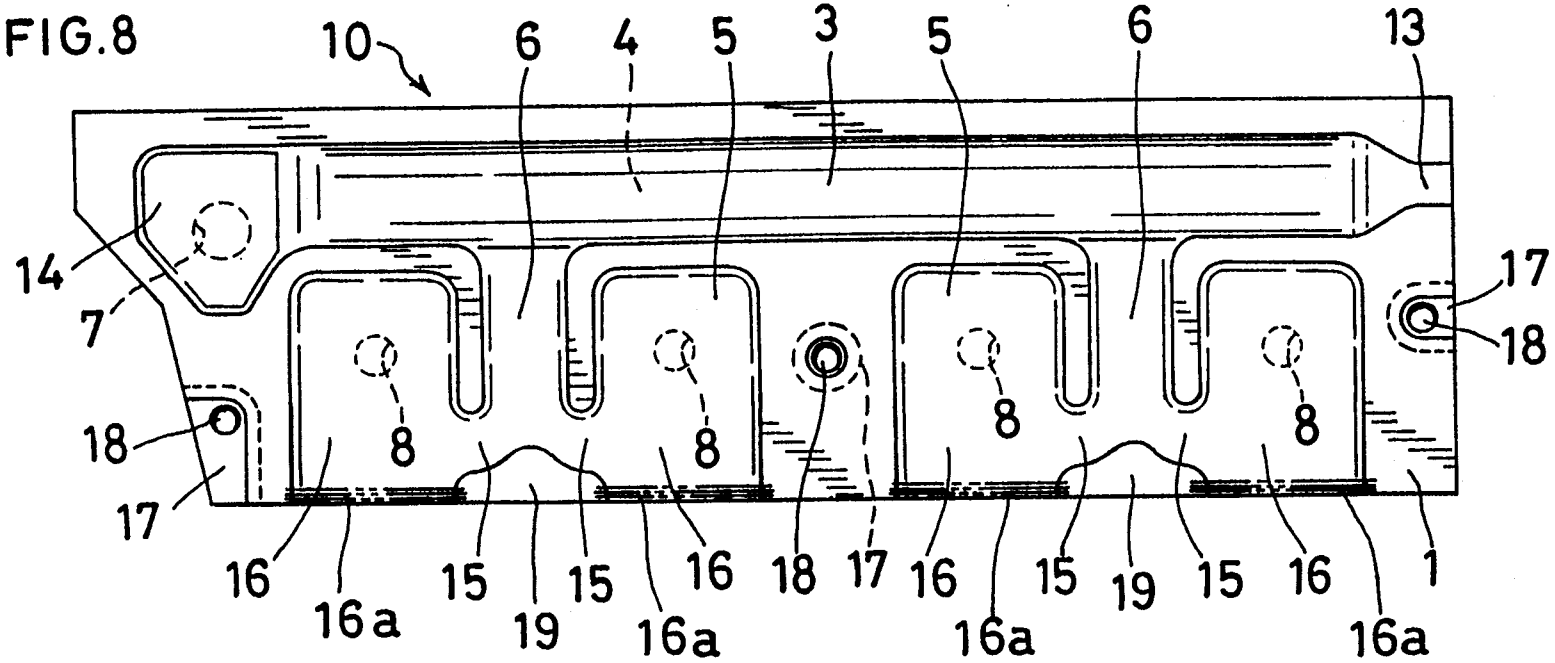
FIG. 8 is a plan view of another exhause gas recycling device, i.e., a second embodiment of the invention.

Next with reference to FIG. 8 showing a second embodiment of the invention, the second embodiment differs from the first embodiment in the configuration of each branch channel 6 of the exhaust gas recycling device 10. More specifically, the branch channel 6 has at its outer end a pressure-bonded portion 19 which is larger than the corresponding portion of the first embodiment. Provided inwardly of this portion 19 is a bifurcated passageway, i.e., communication channels 15, 15 communicating respectively with two gas discharge channels (circuit channels) 16, 16 having a large area when seen from above. Each of the discharge channels 16, 16 has at a side portion an opening 16a formed during the production of the device. The metal plate portions defining the opening 16a are bonded by a press and welded to seal off the opening 16a to ensure airtightness.

Figure 9:
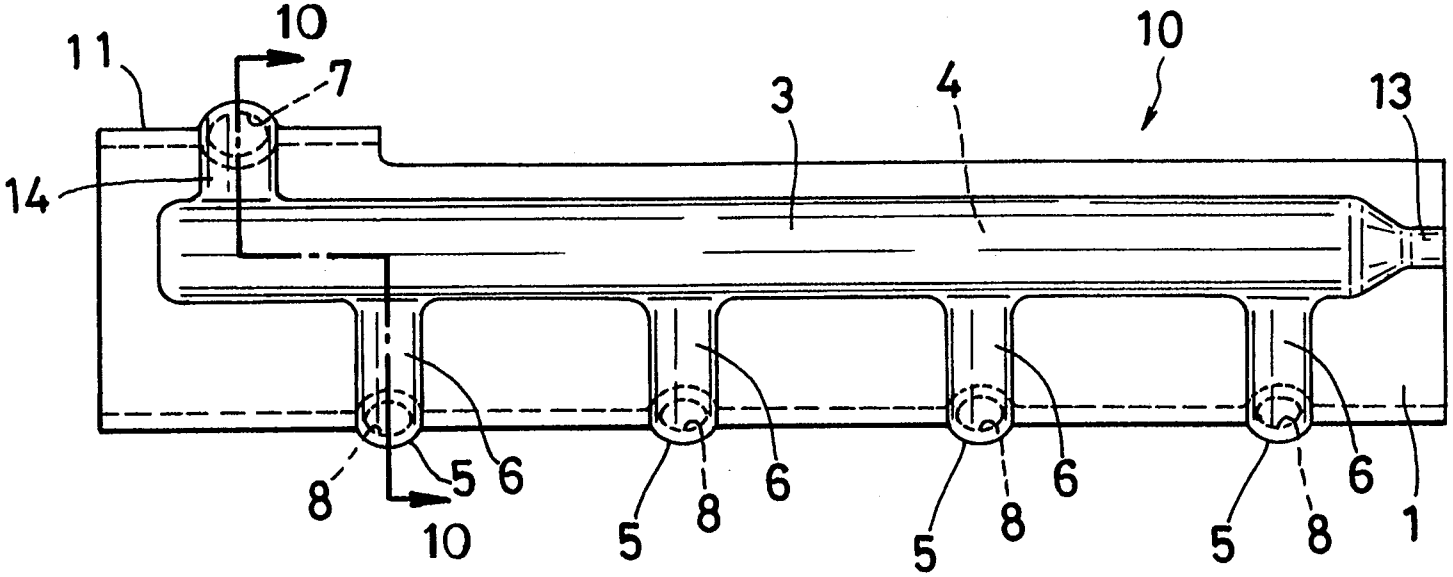
FIG. 9 is a plan view of another exhaust gas recycling device, i.e., a third embodiment of the invention.
Figure 10:
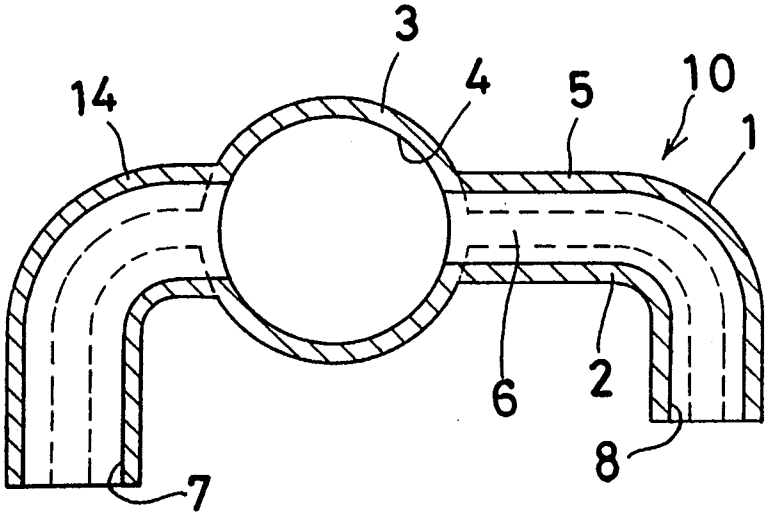
FIG. 10 is an enlarged view in section taken along the line C—C in FIG. 9.

With reference to FIGS. 9 and 10 showing a third embodiment of the invention, the difference of the third embodiment from the first will be described below. The third embodiment includes a first inflated portion 3 having a relatively large circular cross section almost in its entirety except at its oppoisite end portions 13, 14 and defining a main channel 4, four branch channels 6 provided on one side of the infalted portion 3 and communicating with the main channel 4, and an extension 11 provided at the left end portion of the other side of the portion 3 and having a gas inlet channel 14 communicating with the main channel 4. The metal plates 1, 2 joined to each other are bent downward at the front and rear opposite side edge portions thereof to provide a gas inlet 7 at the outer end of the inlet channel 14 and a gas outlet 8 at the outer end of each branch channel 6, the inlet 7 and the outlet 8 each having an opening oriented downward.

The third embodiment requires no boring operation and is diminished in the seal portion formed by welding, so that the exhaust gas recycling device 10 can be produced with greater ease, at a lower cost and with airtightness of improved reliability.

What is claimed is:

1. An exhaust gas recycling device comprising two metal plates 1, 2 superposed on each other, at least one of the metal plates 1, 2 being formed with a first inflated portion 3 having a relatively large cross section and defining a main gas channel 4 and at least one second inflated portion 5 integral with one side of the first inflated portion 3 and having a relatively small cross section to define a branch gas channel 6 in communication with the main channel 4, the two metal plates 1, 2 being joined to each other except at the first and second inflated portions 3, 5, one of the metal plates, 2, having a gas inlet 7 communicating with the main channel 4 and at least one gas outlet 8 communicating with the branch channel 6 and connectable to an intake manifold 20.

2. An exhaust gas recycling device as defined in claim 1 wherein the branch gas channel 6 in communication with the main channel 4 is divided by way of a bifurcated passageway 15 at an outer end thereof into two gas discharge channels 16, 16 having a large area when seen from above, and the gas outlet 8 connectable to the intake manifold 20 is formed in a metal plate portion defining each of the discharge channels 16, 16 at the lower side thereof.

3. An exhaust gas recycling device as defined in claim 2 wherein each of the discharge channels 16, 16 is formed at a side portion thereof with an opening 16a, and metal plate portions defining the opening 16a are bonded together under pressure to seal off the opening 16a.

4. An exhaust gas recycling device as defined in claim 1 wherein the first inflated portion 3 has a relatively large approximately circular cross section, and a plurality of branch channels 6 are provided on one side of the first inflated portion 3 in communication with the main gas channel 4 inside the inflated portion 3, a gas inlet channel 14 being provided on the other side of the first inflated portion 3 in communication with the main channel 4, the joined metal plates 1, 2 being bent downward at front and rear opposite side edge portions thereof to provide the gas inlet 7 at an outer end of the gas inlet channel 14 and the gas outlet 8 at an outer end of each branch channel 6, the inlet 7 and the outlet 8 each having an opening oriented downward.

* * * * *